United States Patent [19]

Stoll et al.

[11] Patent Number: 4,960,393

[45] Date of Patent: Oct. 2, 1990

[54] PLUG CONNECTING DEVICE FOR ELECTRICAL EQUIPMENT

[76] Inventors: Kurt Stoll, Lenzhalde 72, 7300 Esslingen, Fed. Rep. of Germany; Hans H. Glaettli, Seestr. 252, CH-8700 Kuesnacht, Switzerland; Stanislav Zofka, Oberseestr. 81, Jona Bei Rapperswil/St. Gallen, Switzerland

[21] Appl. No.: 300,277

[22] Filed: Jan. 19, 1989

[30] Foreign Application Priority Data

Jan. 21, 1988 [DE] Fed. Rep. of Germany ..... 3801675

[51] Int. Cl.[5] ..... H01R 25/00

[52] U.S. Cl. ..... 439/651; 439/655; 439/166

[58] Field of Search ..... 439/162–166, 439/650–658, 638, 359, 362, 364, 365, 690, 696, 701

[56] References Cited

U.S. PATENT DOCUMENTS

| | | | |
|---|---|---|---|
| 2,567,686 | 9/1951 | Benander | 439/542 |
| 2,910,672 | 10/1959 | Patka | 439/652 |
| 3,510,825 | 5/1970 | Quackenbush | 439/650 |
| 4,346,957 | 8/1982 | Fukao | 439/529 |
| 4,545,632 | 10/1985 | Maier et al. | 439/650 |

FOREIGN PATENT DOCUMENTS

| | | | |
|---|---|---|---|
| 0556523 | 2/1960 | France | 439/651 |
| 1041207 | 9/1966 | United Kingdom | 439/650 |

*Primary Examiner*—David L. Pirlot

*Attorney, Agent, or Firm*—Flynn, Thiel, Boutell & Tanis

[57] ABSTRACT

The invention proposes a connecting plug device for electrical equipment and more particularly rows of solenoid valves in the case of which on one side of a housing there is a contact arrangement for cooperation with an arrangement of mating contacts on the item of electrical equipment. On two further sides of the housing there is a respective set of electrical plug connecting contacts. One plug connecting contact is connected with one plug contact of the contact arrangement and at least one further plug connecting contact is connected with the corresponding opposite plug connecting contact and with a further plug contact electrical, while the remaining plug connecting contacts are connected with the plug connecting contacts arranged offset in relation to the respective opposite plug connecting contacts. Different numbers of such connecting plug devices may be plugged together in different numbers and connected with a corresponding number of solenoid valves, the foremost connecting plug device automatically ensuring the desired association of connections with the individual solenoid valves.

39 Claims, 6 Drawing Sheets

PLUG CONNECTING DEVICE FOR ELECTRICAL EQUIPMENT

BACKGROUND OF THE INVENTION

The invention relates to a plug connecting device for electrical equipment and more especially for magnetic solenoid valves arranged in rows, comprising a housing and a plug contact arrangement arranged on one side of the housing and adapted to be united with a plug contact arrangement on the electrical equipment.

Known plug connecting devices in the form of a male element for solenoid valves are provided with an individual electrical power supply cable for the respective solenoid valve. If there is a large number of solenoid valves arranged in rows there then has to be a correspondingly large number of cables which have to be laid and attached. The result is that it is comparatively simple to confuse a plug during a repair or servicing and such confusion may lead to plant failure owing to the incorrect operation of a pneumatic or hydraulic system.

It is furthermore a known practice to employ multiple plugs adapted to the desired number of solenoid valves or contact arrays producing all the connections. However individual adaptation is complex and expensive and for each application it is necessary to manufacture a special plug or a special contact arrangement.

SHORT SUMMARY OF THE PRESENT INVENTION

One object of the invention is to create a plug connecting device of the initially noted type which may be joined together with other identical connecting devices to form multiple plugs for a variable number of electrical devices.

A further aim of the invention is to devise such a connecting device which may be rapidly and quickly assembled.

In order to achieve these or other objects appearing from the present specification claims and drawings, there are two further opposite housing sides with a number of electrical plug connecting contacts suitably arranged thereon so that one plug connecting contact is connected with one plug contact of the contact arrangement and at least one further plug connecting contact is connected with the corresponding oppositely arranged plug connecting contact and with a further plug contact electrically, while the remaining plug connecting contacts are electrically connected with plug connecting contacts, which are offset in relation to the corresponding oppositely placed plug connecting contacts.

If a plurality of such connection plug devices are joined with each other a multiple plug will result, which is made up of identical elements able to be freely interchanged and whose end contact arrangement has a fixed, defined association with the lined-up items of electrical equipment which are to be connected. Such connection plug devices may be combined to form multiple plugs for a variable number of electrical equipment items without any alteration in the association between the end contacts and the lined-up items. Whatever rearrangement is made within the connection plug devices there is no effect on the correct arrangement of the terminals, and there is no danger of wrong connections being made. The number of the remaining plug connecting contacts on one side determines the maximum number of connection plug devices which may be plugged together. If a larger number is necessary, the same arrangement may be produced a second time and connected to the first one in a reversed fashion so that the two cables connected at their ends extend from each other in opposite directions.

The claims define further preferred features of the invention. In a convenient arrangement for the remaining plug connecting contacts an arrangement along a circular line has proved to be convenient, there being an offset equal to one contact element between the plug connection contacts. If for instance the plug connecting contacts on the connection end of an arrangement of coupled connecting plug devices are numbered along this circular line serially, each respective number on a plug connecting contact will denote that connecting plug device (counting from the foremost connecting plug device), at which a plug contact of the contact arrangement is electrically connected with this plug connecting contact. In this respect it is irrelevant how many connecting plug devices are coupled together.

In order to lead the ground and neutral conductor connect through all connecting plug connections at the same respective position in each case, preferably two plug connecting contacts are connected with the corresponding oppositely arranged plug connecting contacts and with two plug contacts of the contact arrangement. These two plug connecting arranged are preferably arranged clear the line of the remaining plug connecting contacts in order preclude an incorrect insertion of a plug element right from the start and in order to indicate the special function, more especially for the end-on connection of the connection cable.

In order to be able to permanently connect together a number of connecting plug devices at least one access opening extends between housing sides having the plug connecting contacts in order to receive at least one holding element. Such holding elements may either be arranged to be fixed together and designed in the form of retaining screws for instance, whose screw heads each abut one connecting plug device and have a threaded hole for the respective next retaining screw to be inserted or the holding element is designed in the form of a retaining pin extending through more than one connecting plug device. The access openings may be placed centrally or at the corners of the connecting plug devices, which then may in the form of a quadrilateral.

In order to provide a simple manner of electrically connecting the separate or coupled connecting plug devices a cable connection member may be in the form of a female plug device. The individual leads of a cable connected thereto may then be connected in this cable connection member by way of detachable connections, more especially plug connections with fixed contacts of cable connection member individual in a single operation, whereafter this cable connection member may be later used as a plug producing all the electrical connections and plugged to the lined-up connecting plug devices. It is then not possible to confuse the connections. Later modifications in the configuration of the connections in the cable end member are readily possible owing to the detachable connections.

More especially in applications in damp premises it is possible to have seals respectively placed between the connecting plug devices and between one of the connecting plug devices and the cable connection member, such seals preferably being in the form of ring seals. On plugging together the connection connecting plug devices and fixing them in place on each other an automatic sealing action is then produced if such ring seals have previously been inserted.

In accordance with an advantageous design of the invention the plug connecting contacts are formed on one of the sides of the housing in the form of contact pins and on the relatively opposite side are formed as female contact elements or bushings, which form the mating contacts for the contact pins. This makes it possible for the connecting plug devices to be plugged together without any means such as tools. It is however also possible to design the plug connecting contacts identically on the two sides of a housing, preferably in the form of female contact elements or bushings in which case there is an adapter member for connecting two respective connecting plug devices. The advantage in this respect is that it is not necessary to have an projecting contact pins and that internal connecting members of sheet metal may be directly bent to form the bushings.

A particularly advantageous design of the connecting plug devices is one in which the one housing having a cavity is able to be shut off at the two oppositely placed housing sides by contact plates or boards carrying the plug connecting contacts and that one of these contact plates is connected with an intermediate member producing the offset electrical connections. The connecting plug devices may be thus be plugged together in a simple manner and—if desired—screwed together.

The production of the electrical connections may be carried out in a simple manner if the intermediate member, which is made of nonconducting material, substantially fills up the cavity and has recesses accommodating electrical contact and connecting elements, the inner surface of the housing forming a mating sliding surface for these elements in the inserted condition. In this respect the individual parts may be produced as simple plastic moldings in which case for producing the electrical connections it is only necessary to insert the contact and connecting elements into the recesses of the intermediate member. On plugging together the parts there is then an automatic location, this being especially satisfactory if the recesses are arranged in two separate arrays in the end zones with a peripheral distribution and receive suitably formed bushing-like parts of the contact and connecting elements. The offset connections are then produced via a connecting link, causing the offset, between two bushing-like parts. The bushing-like parts then offer the advantage that they are both able to be used as contact bushings and also able to accommodate contact pins so that individual adaptation of the structure is possible.

If the side of the housing carrying the contact arrangement is provided with at least two recesses receiving the male contacts and extending as far as the cavity and if furthermore the inner ends of the male contacts are provided with bushing-like, parts, which are fitted into suitably shaped recesses, it is then possible for the male contacts also to be used as prefabricated metallic units which are internally plugged into the housing and then secured in place by the intermediate member. These bushing-like parts are then continuous so that they extend from one contact plate to the next and fit through continuous recesses on the intermediate or on the inner side of the housing. In this case as well it is preferred for one end of the bushing-like parts to serve as a contact busing, while the other end is formed to receive the associated contact pins or serves as a further contact bushing.

The contact plates each have an array of holes which permits access to the contact bushings or the passage of the contact pins. It is in this manner that they may be suitably assembled and used for two applications.

Working embodiments of the invention will now be described with reference the drawing in the ensuing account.

LIST OF THE SEVERAL VIEWS OF THE DRAWINGS

DETAILED ACCOUNT OF EMBODIMENTS OF THE INVENTION

Figure 1:
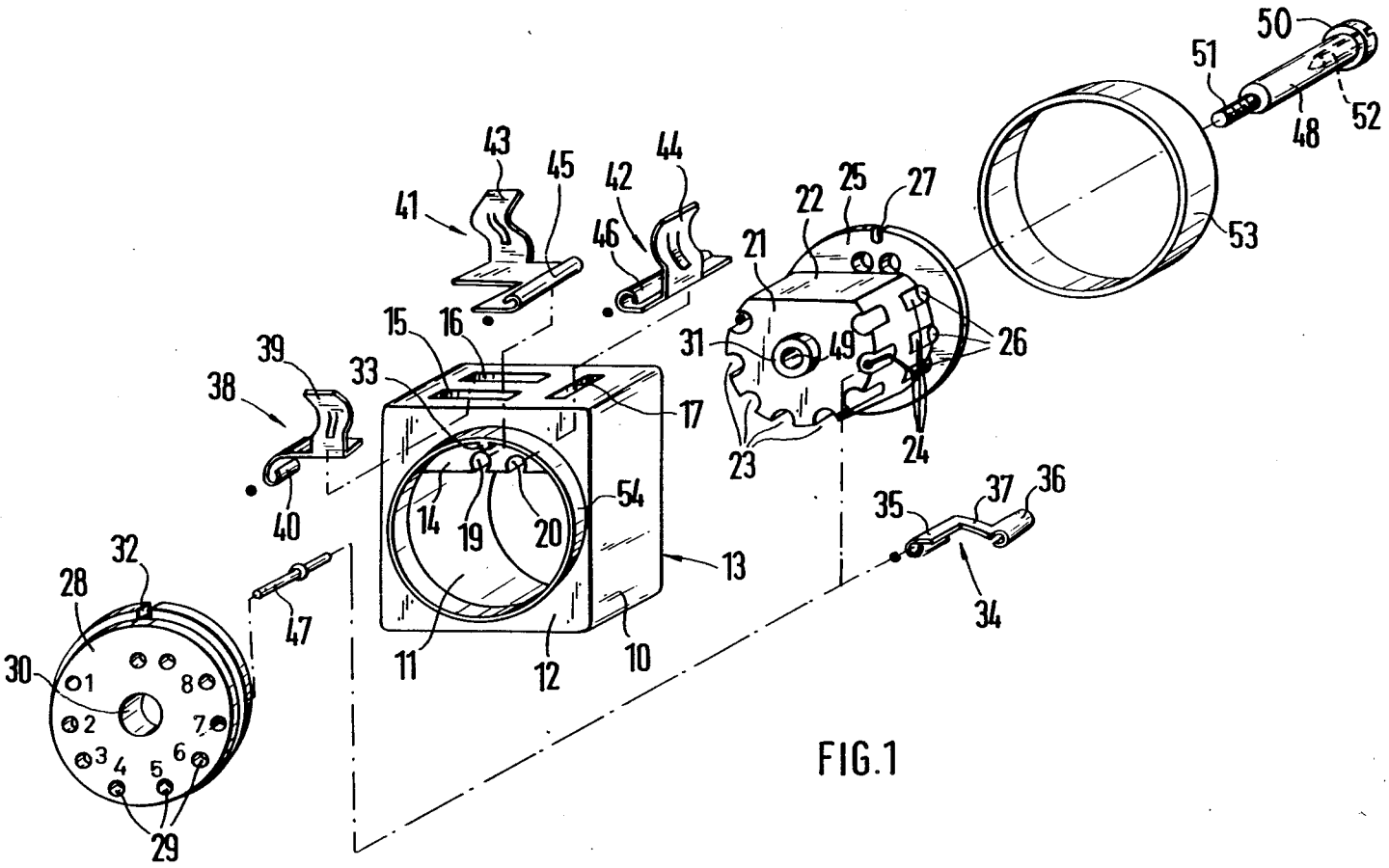
FIG. 1 shows a first working example of the invention in the form of a connecting plug device in an exploded view.

In the case of the first working embodiment of the invention shown in FIG. 1 a block-like housing 10 of a connecting plug device has through a opening 11 extending from a first housing side 12 as far as an opposite second housing side 13. The opening has a generally circularly cylindrical form although a part 14 with a circular segment section extends downwards thereinto. Three slot-like channels 15, 16 and 17 extend from the opening 11 as far as the upper side 18 of the housing. In this respect two channels 15 and 16 extend parallel to each other and parallel to the housing sides 12 and 13 and the third channel 17 runs perpendicularly thereto. In the part 14 there are two adjacent groove-like recesses 19 and 20 which are open towards the opening 11 and extend in the longitudinal direction.

An intermediate member 21 able to be inserted into the opening 11 has a form corresponding to this opening, that is to say, it has a circularly cylindrical form provided with a flat 22. The flat 22 which has a plane surface abuts, in the inserted condition, on the part 14 and shuts off the two recesses 19 and 20. At its two round edges the intermediate member 21 has two arrays of recesses 23 and 24, which are distributed over the periphery and are essentially in the form of grooves, extending essentially as far as the respective end sides, with a semicircular cross section. At one end side a circular contact plate 25 is secured, which has an array 26 of holes, which in the assembled state form extensions of the recesses 24 and, respectively, of the recesses 19 and 20. Furthermore this contact plate 25 has a depression 27 at a peripheral part into which there fits a proud part of the housing 10 not shown in the drawing in order to ensure location or alignment of the contact plate 25. If the contact plate 25 is permanently joined to the intermediate member 21, it is possible to dispense with this depression 27, since the flat 22 then ensures proper alignment by cooperating with the part 14.

A second contact plate 28 of similar design is also provided with a corresponding hole array 29 and has a central guide hole 30, into which there fits a tubular pin 31 on the associated end side of the intermediate member 21 in the assembled state. Furthermore the contact plate 28 in turn has a marginal depression 32, which prevents twisting by cooperating with a proud part 33 on the housing 10.

In the recesses 23 and 24 in the intermediate member 21 it is possible for connecting elements 34 to be fitted, which are formed by electrically conducting sheet metal members and which at their two ends have parts 35 and 36 which are suitably bent at their two ends and whose shape is essentially the same as the shape of the recesses 23 and 24. The two bushing-like parts 35 and 36 are in this case connected together in such a manner by a transversely extending sheet metal strip 37 that the two bushing-like parts 35 and 36 when inserted cause an offset of the electrical connections by one recess 23 or, respectively, 24, that is to say one recess 23 is not electrically connected with the oppositely placed recess 24 but with the recess 24 which is offset in relation thereto. On insertion of the intermediate member 21 into the opening 11 the inner wall face of this opening 11 causes location in place of the connecting elements 34.

A first male contact 38, bent from a piece of sheet metal, extends from the opening 11 and fits into the slot-like channel 15 so that a part 39, like a flat plug, extends from the channel 15, while the oppositely placed bushing-like part 40 forming the end fits into the first recess 23 along the flat 22 and spaced from it in the counterclockwise direction. This recess 23 is thus not electrically connected with the recesses 24. Two further male contacts 41 and 42 are designed in a similar manner, that is to say they also have a part 43 and 44 in the form of a flat plug and a bushing-like part 45 and 46, the flat plug-like parts 43 and 44 extending out of the channels 16 and 17 in the inserted state, while the bushing-like parts 45 and 46 are located in the recesses 19 and 20 in the inserted state. These bushing-like parts 45 and 46 are continuous, that is to say. they respectively extend from the contact plate 25 as far as the contact plate 28.

Figure 2:
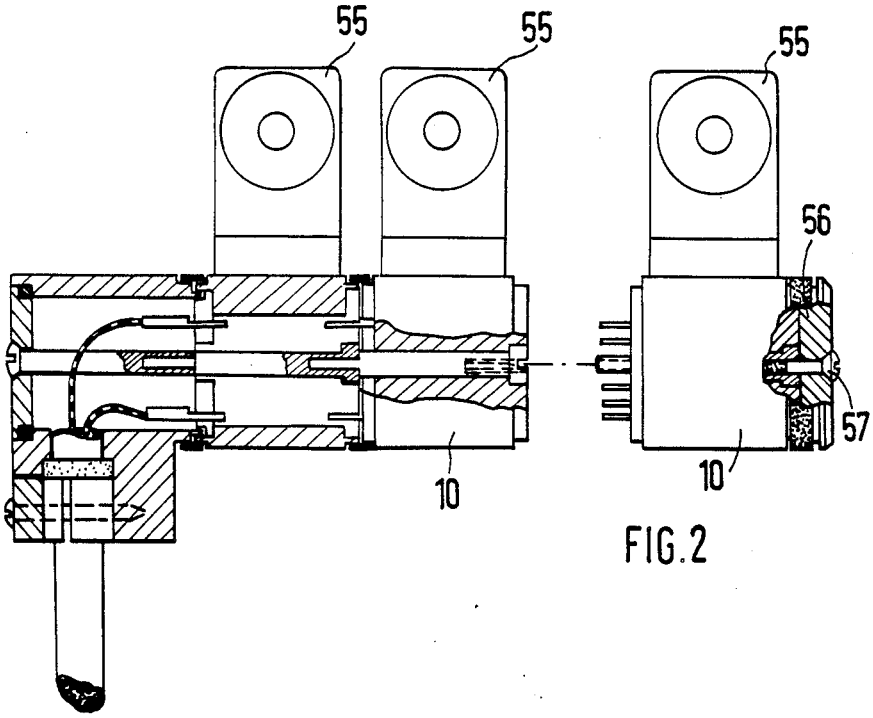
FIG. 2 shows connecting plug devices in a plugged-together form and provided with a cable connection member, partly in longitudinal section and partly in side view.

For assembly the first step is to insert the three male contacts 38, 41 and 42 extending from the opening 11 into the slot-like channels 15 and 16 and then the connecting elements 34 are inserted into the recesses and then the connecting elements 34 are fitted into the recesses 23 and 24, seven connecting elements 34 being needed in the present working example of the invention. After this the intermediate member 21 is fitted into the opening 11 so that all the male contacts and connecting elements are secured in place. After this from the housing side 12 contact pins 47 are fitted into the bushing-like parts 35, 40, 45 and 46 and after this the contact plate 28 is so placed in position that the contact pins 47 extend through the array 29 of holes. The arrangement may then be clamped tight by a holding screw 48 which is able to be inserted into a central longitudinal hole 49 in the intermediate member 21. A screw head 50 is then received in a depression, not to be seen in the figure, in the contact plate 25. A screw thread 51 on the opposite end of the holding screw 48 in the fitted state then extends out of the tubular pin 31 and may be screwed into the screw head 50 of the retaining screw which is fitted into the adjacent connecting plug device. For this purpose the screw head 50 has a threaded hole 52. It is in this manner that an adjustable number of connecting plug devices, assembled in this way, may be plugged together and fixed by screws as is shown in FIG. 2. Between two respective connecting plug devices a gasket ring 53 is placed on a proud annular part 54 on the first housing side 12 which during screwing together makes sealing engagement with the opposite sides of the housing.

On plugging together the connecting plug devices the contact pins respectively extending from the contact plate 28, pass through the array 26 of holes into the bushing-like parts 36, 45 and 46 and produce the respective electrical connections. In this respect the ground and neutral connection is always extended through all connecting plug devices in the bushing-like parts 45 and 46 so that the male contacts 43 and 44 of all the connecting plug devices are connected in the same manner with ground and, respectively, with the neutral conductor. The design, causing an offset, of the connecting elements 34 means on the other hand that the male contact 38 of a connecting plug device is offset by one further contact pin 47 in the counterclockwise direction for each lead through. As a result the connections on the foremost contact plate 28 may readily be identified. The connection 1 is electrically connected with the male contact 38 of the associated connecting plug device and for instance the connection 5 is connected with the male contact 38 of the fifth plugged on connecting plug device. Confusion of the connecting plug devices within a set thereof is then unimportant, since they all have the same structure The assembled connecting plug devices may then be inserted jointly using the male contacts 38, 41 and 42 into suitably arranged solenoid valves 55 for the electrical operation thereof. The last connecting plug device is provided with an insulating connection plate 56, which is able to be fixed by means of a screw 57 on the holding screw 48 of the corresponding connecting plug device.

Figure 3:
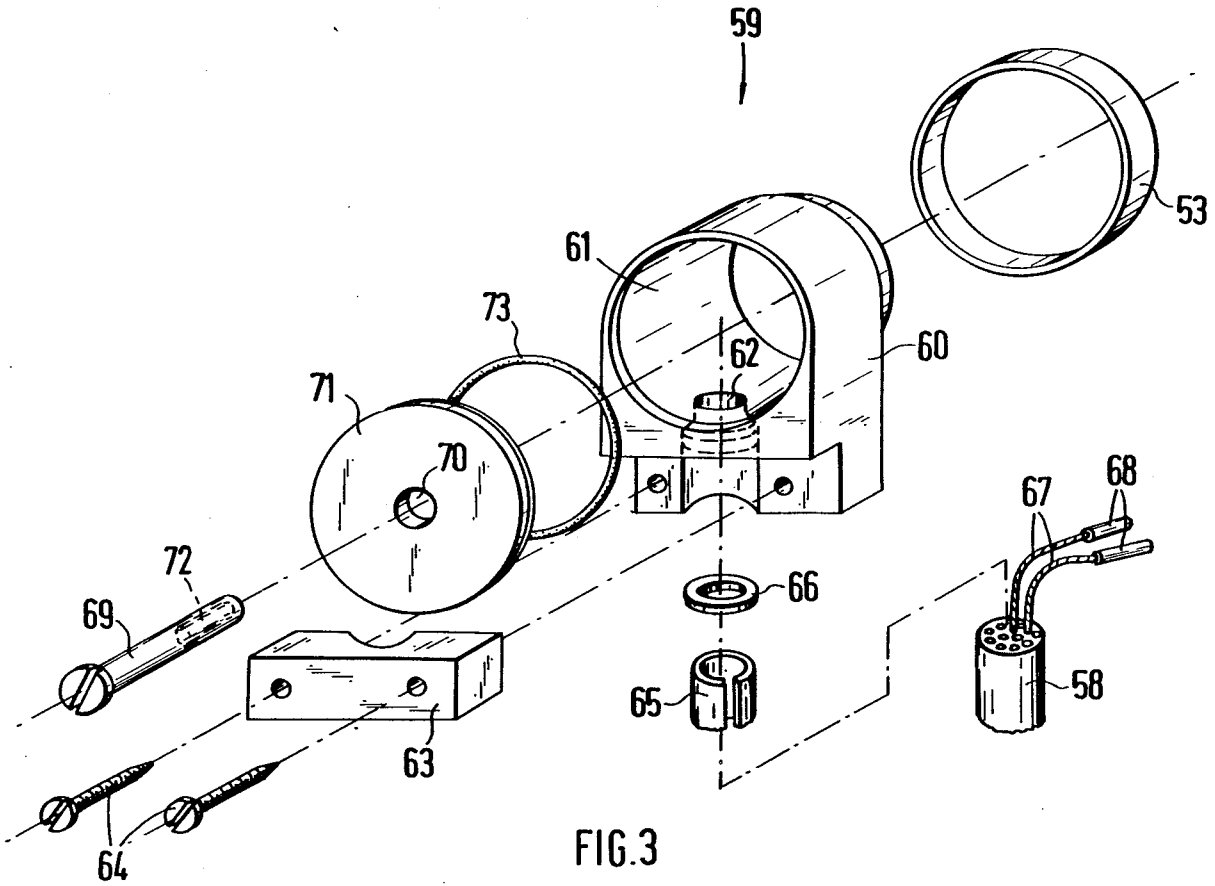
FIG. 3 shows a working example of the invention in the form of a cable connection member in an exploded view.

The connection with a connection cable 58 is by means of a cable connection member 59, which is able to slipped onto the contact plate 28 of the foremost connecting plug device so that the electrical connections of all connecting plug devices are then produced. This cable connection member 59 is shown in detail in an exploded view in FIG. 3.

A housing 60 has an opening 61 corresponding to the through opening 11 and into it there opens a channel 62 permitting the insertion of the connection cable 58. The housing part surrounding the channel 62 is halved adjacent to the outer opening, that is to say a fixing member 63 forming one channel half is able to be screwed to the rest of the housing by means of screws 64. Between the fixing member 63 and the housing 60 there is a gripping sleeve 65 and a disk 66, the gripping sleeve 65 surrounding the end of the connection cable 58 and holding it in place when the fixing member is screwed home. The separate leads 67 of the connection cable 58 are provided with connecting bushings 68 at their ends, which after fixing the connection cable 58 in the channel 62 are connected with the contact pins 47 of the foremost connecting plug device. The coordination may then be ensured by different colors of the leads 67 to indicate their association with the numbered connections. Previously a gasket ring 53 will have been placed between the cable end member 59 and the adjacent connecting plug device. After this the cable connection member 59 is fixed in place by means of a holding screw 69, which is inserted through a central hole 70 in a housing cover 71 and then is screwed to the holding screw 48 in the adjacent connecting plug device. For this purpose the holding screw 69 has a suitable tapped hole 72. The housing cover 71 has a gasket ring 73 between it and the housing 60 which it engages and seals off the opening 61.

Figure 4:
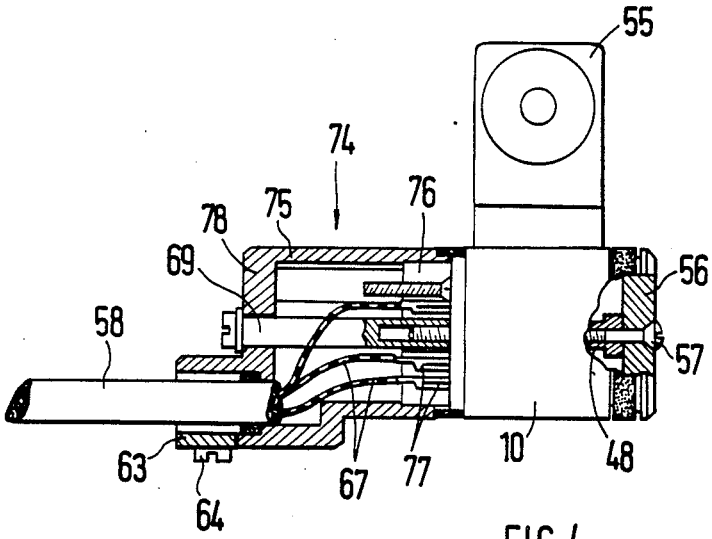
FIG. 4 is a longitudinal section and partial side view of a cable connection member.

In place of the individual connections of the leads 67 with the contact pins 47 it is possible for the cable connection means 59 to be designed in the form of a multiple bushing, in which the necessary connections are produced internally and which may be slipped in a single plugging operation onto a connecting plug device. Such an arrangement is shown in FIG. 4. Unlike the cable connection member 59 shown in FIG. 3, this cable connection member 74 has a contact plate 76 which may be inserted into a housing 75 and in the plate 76 connection bushings 77 may be inserted or are inserted in a configuration which corresponds to the array 29 of holes. These connection bushings 77 are connected with leads 67. At the opposite end of the housing 75 the latter is shut off by an integrally molded terminating plate 78 but this plate does have a channel 79 in order to receive the connection cable 58. This channel is able to be separated, as in FIG. 3, by virtue of there being the fixing member 63 and constitutes a clamping fixing device.

Figure 5:
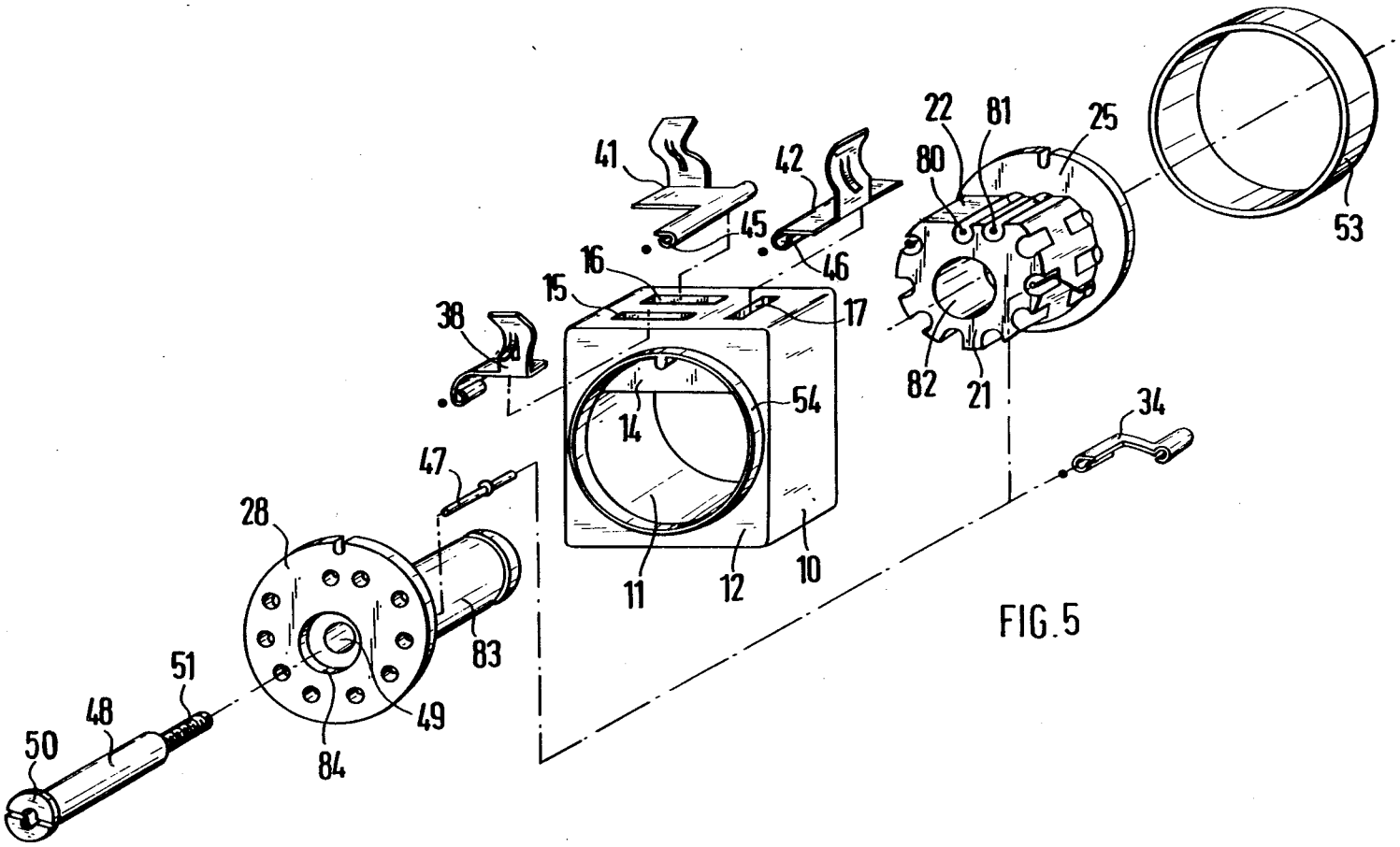
FIG. 5 shows an exploded view of a second working example of the invention in the form of a connection plug device.

FIG. 5 shows a further example of a connecting plug device in an exploded view, the structure having many similarities with the connecting plug device of FIG. 1 so that similar or similarly operating features are provided with the same reference numbers and are not described a second time.

There are more particularly differences inasmuch as the part 14 does not have any recesses 19 and 20 in the longitudinal direction and instead suitable recesses 80 and 81 are formed in the flat 22 of the intermediate member 21. Accordingly the bushing-like parts 45 and 46 of the male contacts 41 and 42 are not rolled inwards in an upward direction but downwards in order to be able to fit into the recesses 80 and 81. A further difference is to be seen in the fact that the intermediate member 21 does not have any tubular pin 31 and it has a central hole 82 with a widened diameter into which a tubular pin 83, connected with the front contact plate 28, fits in the assembled state. Lastly the holding screw 48 is inserted in the opposite direction, for which purpose the contact plate 28 has a recess 84 to receive the screw head 49. The longitudinal hole 49 now extends through the tubular pin 83 and receives the holding screw 48.

Further modifications in the illustrated form of the connecting plug device are naturally possible and for example the housing 10 may for instance be round and its through opening 11 or, respectively, the suitably formed intermediate member 21 may have a polygonal outline. In place of the flat 22 it is also possible to have another outline or other means, which ensure that twisting is not possible, the flat being dispensed with entirely if desired so that the recesses 80 and 81 are arranged on the periphery corresponding to the recesses 23 and 24 but extend right the way through. Furthermore the contact pins 47 may have a different shape, for example in the form of flat plugs. They may furthermore be fixedly joined to the contact plate 28 and more especially cast in it. The same applies for the male contacts 38, 41 and 42. The arrangement of the male contacts 38, 41 and 42 is naturally completely free and depends on the necessary connection configuration of the solenoid valves. Furthermore the connecting elements 34 may be connected permanently with the intermediate member 21, and in place of the sheet metal strip 37 it is also possible to have a connecting wire.

Figure 6:
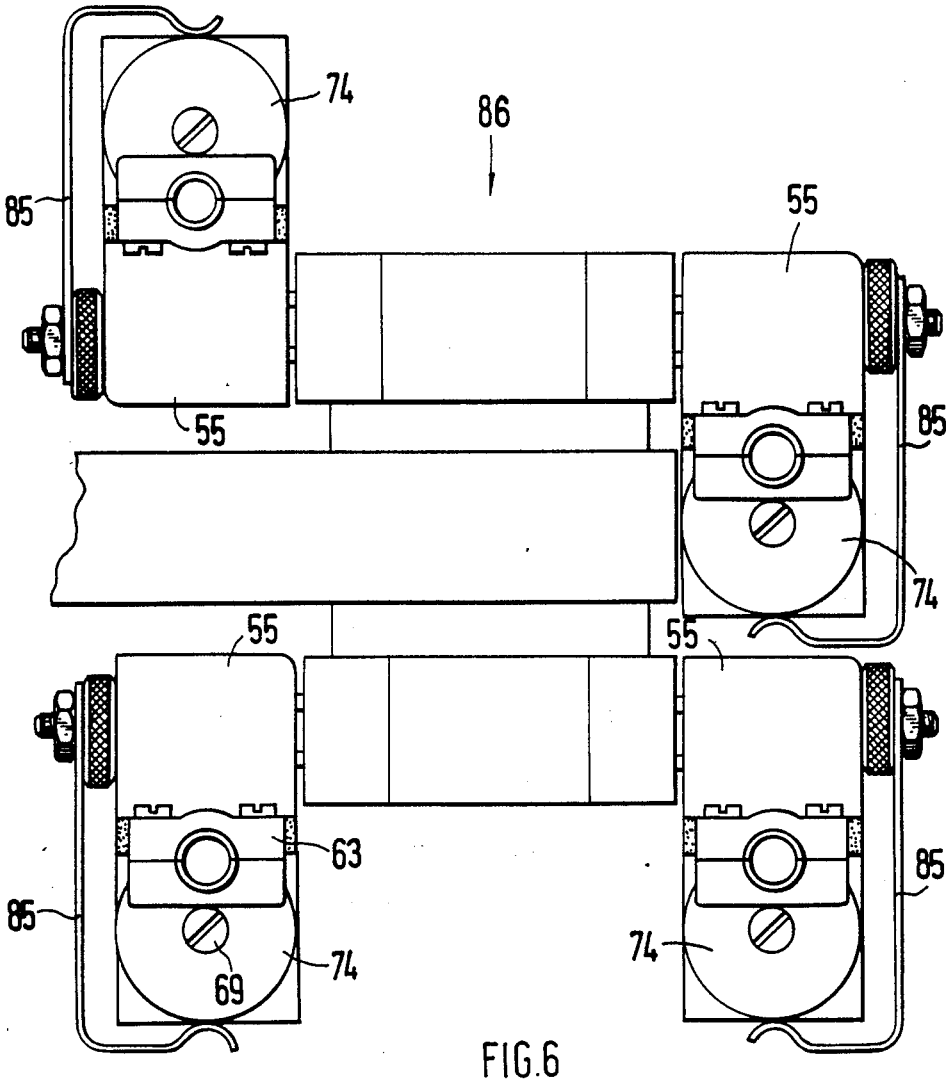
FIG. 6 shows by way of example several arrangements of connecting plug devices on a solenoid valve unit.

FIG. 6 shows some possible ways of applying connecting plug devices assembled in a row on solenoid valves, which are arranged in a large valve unit 86. For attachment there are substantially L-like spring links 85 screwed to the solenoid valves 55, which fit around half of the connecting plug devices and press them resiliently against the solenoid valve 55.

Figure 7:
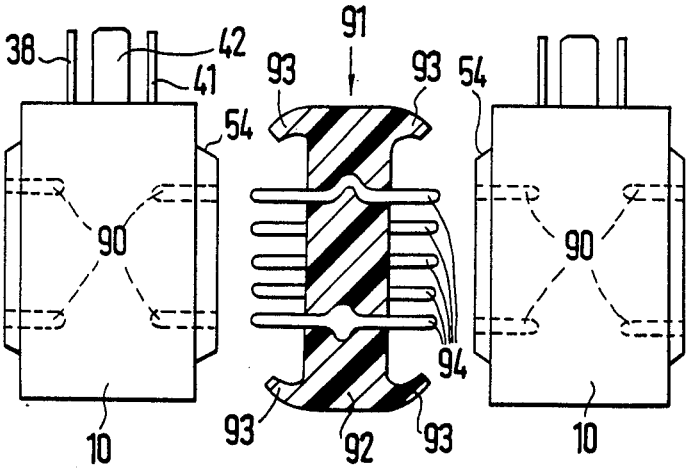
FIG. 7 is a view of a further working example of the invention with an adapter member between two connecting plug devices.

In FIG. 7 the housings 10 of two connecting plug devices are shown, which unlike the embodiments so far shown on the facing contact faces are only provided with contact bushings 90. For simplification only two of these contact bushings 90 are marked in broken lines, although they may have an arrangement as in the previous working examples. The internal structure may again be like the structure of the embodiments described so far, that is to say there is an intermediate member which is provided with connecting elements 34. The latter, like the plug contacts 38, 41 and 42, may then be designed in the same manner but without the contact pins 47.

For connecting two such connecting plug devices there is an adapter member 91, which consists mainly of the a disk-like holding member of elastic plastic material, which is provided on its outer edges with sealing lips 93. These sealing lips 93 rest, in the assembled condition, on the housings 10 and, respectively, the annular parts 54 to make a seal. There are plug pins 94 extending through the holding member 92, and these pins are elastically fitted into suitable openings or are cast in place. The respective free ends fit into adjacent contact bushings 90, in the assembled condition, of connecting plug devices. To anchor the holding member 92 the plug pins 94 have a bent out part, a thickened part or some other irregularity in the middle which causes an anchoring effect. By suitable dimensioning of the adapter member 91 it is possible to set the distance between two connecting plug devices and in this distance a sealing connection is secured.

Figure 8:
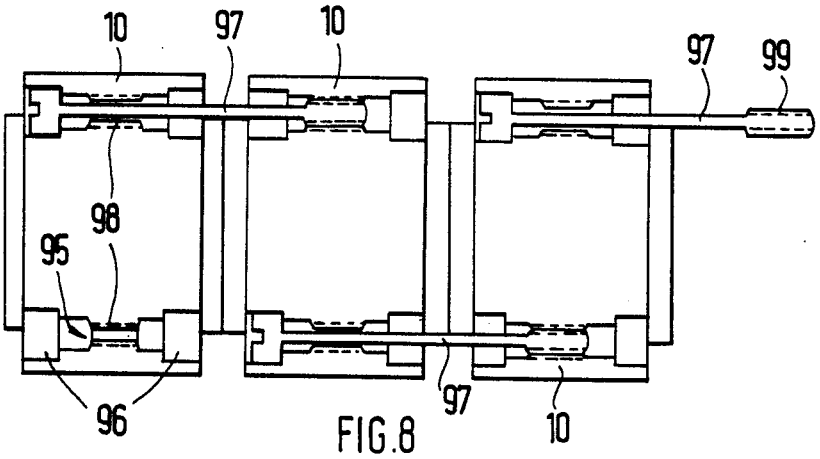
FIG. 8 shows a still further form of the invention involving holding elements for the connection of connecting plug devices.

FIG. 8 shows a further possible way of ensuring a reliable connection between connecting plug devices to each other, such design naturally also being applicable to the design as shown in FIG. 7. Unlike the designs so far described, in which the connection between the members is caused by a central holding screw, the block-like housings 10 now have through holes 95 at the four corner parts, which at their openings are provided with recesses 96 to receive heads of holding screws 97. In the middl part this through hole 95 has a narrower threaded part 98. The holding screws 97 are provided with a terminal screw 99, which has a larger diameter tha the remaining part. The length of these holding screws 97 is such that in each case they extend from the threaded part 98 of a housing 10 as far as the opposite recess 96 of the adjacent housing 10. The thread 99 is then screwed into the screwed part 98.

For the connection of two housings the latter are firstly plugged together and then two such holding screws 97 are screwed into diagonal through holes 95. If now a further housing is plugged on two holding screws are screwed into the through holes 95 of the opposite diagonals. For simplification FIG. 8 only shows the through holes 15 in one plane. The holding screws 97 may be permanently attached on a housing 10 by screwing the thread 99 through the threaded part 98 and out the other side. The holding screw 97 is thus able to be slid but may be however pulled out without any screwing motion. It is naturally also possible for the holding screws described 48 to be used in the corner parts.

Figure 9:
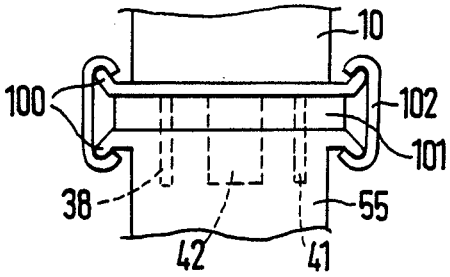
FIG. 9 shows a further example for a holding device fixing in place the connecting plug device on an item of electrical equipment.

FIG. 9 shows a further holding means—as an alternative to the spring link 85 in FIG. 6—for the attachment of the connecting plug devices and, respectively, housings 10 on solenoid valves 55. In this case in the sides which in the plugged-together state are opposite are provided with retaining beads 100 which are directed oppositely away from each other obliquely. Between the oppositely arranged faces there is a seal 101 of soft elastic material. A holding member 102 in the form of a section has the form of a letter U and has its two limbs slipped onto the oppositely arranged retaining bead 100 of the housing 10 and of the solenoid valve 55. By pressing together the seal 101 this slipping over operation is greatly facilitated. On then releasing the seal 101 the retaining bead 100 presses resiliently against the retainer member 102.

In place of a U-like form of design it would also be possible to have two straight retainer members or a number of retainer members might be made like clamps. The retainer beads 100 may be molded on, screwed on or secured to the housing 10 on the one hand and on the solenoid valve 55 on the other in some other way.

We claim:

1. An apparatus comprising a plug connecting device for electrical equipment, said plug connecting device including: a housing, a plug contact arrangement which includes first and second plug contacts arranged on one side of the housing, and first and second groups of electrical plug connecting contacts arranged on respective portions of the housing, the plug connecting contacts of each said group being arranged in identical contact patterns, a first and a second of the plug connecting contacts of the first group having positions in the pattern respectively identical to positions in the pattern of a first and a second of the plug connecting contacts of the second group, the first plug connecting contact of the first group being connecting with the first plug contact the plug contact arrangement and the second plug connecting contact of the first group being connected with the second plug connecting contact of the second group and with the second plug contact, each of the plug connecting contacts of the first group other than the first and second plug connecting contacts thereof being electrically connected with a respective one of the plug connecting contacts of the second group other than the second plug connecting contact and located at a different position in the contact pattern so that the first plug connecting contact of the second group is connected to one of the plug connecting contacts of the first group other than the first and second plug connecting contacts thereof.

2. The apparatus as claimed in claim 1 wherein the plug connecting contacts of one of the groups are contact pins and the plug connecting contacts of the other of the groups are contact bushings which form mating contacts for the contact pins.

3. The apparatus as claimed in claim 1 wherein the plug connecting contacts of each said group other than said first and second plug connecting contacts thereof are arranged in a curved row.

4. The apparatus as claimed in claim 3 wherein each said plug connecting contact in the curved row of the first group and the plug connecting contact of the second group connected with it are offset from each other by one contact position in the curved rows.

5. The apparatus as claimed in claim 1 wherein the first and second groups each further include a third plug connecting contact, and the plug contact arrangement includes a third plug contact electrically connected with each of the third plug connecting contacts to produce a ground wire connection, the second plug connecting contacts and the second plug contact producing a neutral wire connection.

6. The apparatus as claimed in claim 5 wherein the second and third plug connecting contacts of each said group are arranged clear of the remaining plug connecting contacts of such group.

7. The apparatus as claimed in claim 1 wherein the first and second groups are respectively provided on opposite housing sides, and wherein the housing has a through opening extending between the opposite housing sides and has a holding element extending through the through opening.

8. The apparatus as claimed in claim 7 including a further plug connecting device having therethrough a through opening, and wherein the holding element is in the form of a holding bolt extending through the through opening of each of the plug connecting devices.

9. The apparatus as claimed in claim 7 wherein the holding element is a holding screw having a head which abuts in or on the plug connecting device and having threads able to be screwed into a threaded part of a further plug connecting device, the threads at the end of the holding screw having a larger diameter than the rest of a shank of the screw.

10. The apparatus as claimed in claim 7 including means for fixing to said first-mentioned plug connecting device two further plug connecting devices, the further plug connecting devices having holding elements which are adapted to be coupled to the holding element of the first-mentioned plug connecting device.

11. The apparatus as claimed in claim 10 wherein the holding elements are in the form of holding screws whose heads respectively abut in or on a plug connecting device and have a tapped hole to threadedly receive part of a respective adjacent holding screw.

12. The apparatus as claimed in claim 1 comprising a cable connection member formed as a plug device able to be coupled to one end of the plug connecting device.

13. The apparatus as claimed in claim 12 wherein the cable connection member has a detachable clamping device for one end of a cable and male contacts connected with individual leads of the cable, such male contacts being arranged in a fixed or loose manner.

14. The apparatus as claimed in claim 11, including a further plug connecting device and means coupling the further plug connecting device to the first-mentioned plug connecting device, and including an insulating terminal plate which is able to be slipped or screwed to the further plug connecting device.

15. The apparatus as claimed in claim 12 wherein the cable connecting member has a housing and a through opening extending between a contact side of the housing and an opposite housing side, and has a holding element disposed in the through opening.

16. The apparatus in claim 15, wherein the plug connecting device includes a holding element, and wherein the holding element of the cable connecting member is able to be screwed to the holding element of the plug connecting device.

17. The apparatus as claimed in claim 11, including a further plug connecting device operatively coupled to the first-mentioned plug connecting device, and including seals between the plug connecting devices and between one of the plug connecting devices and the cable connection member.

18. The apparatus as claimed in claim 17 wherein the seals are annular gaskets able to be clamped between two respective housing sides.

19. The apparatus as claimed in claim 1 wherein the plug connecting contacts in each of the groups are identical and are contact bushings and including an adapter member having means for connecting the plug connecting contacts of one of the first and second groups of the plug connecting device to a group of plug connecting contacts of a further plug connecting device.

20. The apparatus as claimed in claim 19 wherein the plug connecting contacts of each of the plug connecting devices are contact bushings, and wherein the adapter member has a disk-like holding member and has a plurality of continuous plug pins which each engage respective contact bushings of the two plug connecting devices and are each anchored in the disk-like holding member.

21. The apparatus as claimed in claim 20 wherein the plug pins have an irregularity in a middle part thereof to anchor them in the disk-like member.

22. The apparatus as claimed in claim 20 wherein the disk-like member is made of elastic insulating material and has sealing lips which engage the plug connecting devices.

23. The apparatus as claimed in claim 1 wherein the housing has a through opening which is closed by two contact plates respectively carrying the plug connecting contacts of the first and second groups, and wherein one of these contact plates is connected with an intermediate member having means facilitating the electrical connections between the plug connecting contacts of the first group other than the first and second plug connecting contacts and the associated plug connecting contacts of the second group.

24. The apparatus as claimed in claim 23 wherein the intermediate member is made of nonconducting material and substantially fills up the through opening and on its peripheral surface has recesses for electrical connection elements which have as parts thereof the plug connecting contacts, and wherein an inner surface of the through opening in the housing serves as a counter holding surface for holding the electrical connection elements in the recesses when the intermediate member is disposed in the through opening.

25. The apparatus as claimed in claim 24 wherein the recesses are grouped into two sets of recesses each arranged in a spaced out manner in a respective end part of the intermediate member abutting a respective one of the contact plates, each recess receiving a suitably shaped bushing-like part of one of the electrical connection elements.

26. The apparatus as claimed in claim 25 wherein the electrical connection elements each include two of the bushing-like parts which are respectively disposed in two of the recesses located in the respective end parts of the intermediate member and which are joined with each other by a connecting link.

27. The apparatus as claimed in claim 23 wherein the housing side bearing the plug contact arrangement is provided with at least two recesses respectively receiving portions of the first and second plug contacts and communicating with the through opening, and wherein inner ends of the plug contacts are provided with bushing-like parts which fit into suitably formed recesses provided in the plug connecting device.

28. The apparatus as claimed in claim 27 wherein the suitably formed recess into which the bushing-like part of the first plug contact fits is provided in the intermediate member.

29. The apparatus as claimed in claim 27 wherein the bushing-like parts of the plug contacts and the suitably shaped recesses in which they are disposed each extend from one of the contact plates to the other thereof, and one end of each of the bushing-like parts forms a contact bushing and the other end forms a socket.

30. The apparatus as claimed in claim 29 wherein the recesses which receive the bushing-like parts of the plug contacts are provided in an inner surface of the through opening in the housing and the bushing-like parts are held in the recesses by an outer surface of the intermediate member.

31. The apparatus as claimed in claim 29 wherein the recesses which receive the bushing-like parts of the plug contacts are provided in the intermediate member.

32. The apparatus as claimed in claim 31 wherein the intermediate member is generally cylindrical in form and has a flat surface abutted by a correspondingly formed flat surface of the housing, and the recesses are provided in the region of these flat surfaces.

33. The apparatus as claimed in claim 23 wherein the contact plates each have an array of holes therein which permits access to the plug connecting contacts of a respective one of the first and second groups.

34. The apparatus as claimed in claim 33 wherein the contact plates have means for preventing twisting thereof relative to the housing.

35. The apparatus as claimed in claim 1 including an item of electrical equipment which can be coupled to the plug connecting device so that plug contacts of the item engage the first and second plug contacts, and wherein the plug connecting device has holding means for releasably holding the item of electrical equipment in a state coupled to the plug connecting device.

36. The apparatus as claimed in claim 35, wherein the holding means includes a spring link attached to the electrical equipment item and at least partly fitting around the plug connecting device.

37. The apparatus as claimed in claim 35 wherein the holding means includes the plug connecting device and the electrical equipment item each having a holding bead and includes a holding member fitting around the holding beads.

38. The apparatus as claimed in claim 37 wherein the holding member is U-shaped and has holding edges curved towards each other.

39. The apparatus as claimed in claim 37 wherein soft elastic seals are provided between the plug connecting device and the item of electrical equipment.

* * * * *

UNITED STATES PATENT AND TRADEMARK OFFICE

CERTIFICATE OF CORRECTION

PATENT NO. : 4 960 393

DATED : October 2, 1990

INVENTOR(S) : Kurt STOLL et al

It is certified that error appears in the above-identified patent and that said Letters Patent is hereby corrected as shown below:

Column 9, line 51; change "connecting" to ---connected---.

line 52; after "contact" (first occurrence) insert ---of---.

Column 10, line 63; change "11" to ---12---.

Column 11, line 11; change "11" to ---12---.

Signed and Sealed this

Third Day of March, 1992

*Attest:*

HARRY F. MANBECK, JR.

*Attesting Officer*

*Commissioner of Patents and Trademarks*